US006889679B2

(12) United States Patent
Chattin

(10) Patent No.: US 6,889,679 B2
(45) Date of Patent: May 10, 2005

(54) CABLE VIBRAGUARD

(75) Inventor: Jesse R. Chattin, Tampa, FL (US)

(73) Assignee: Vibraguard Corporation, Brandon, FL (US)

( * ) Notice: Subject to any disclaimer, the term of this patent is extended or adjusted under 35 U.S.C. 154(b) by 0 days.

(21) Appl. No.: 10/758,665

(22) Filed: Jan. 15, 2004

(65) Prior Publication Data

US 2004/0144376 A1 Jul. 29, 2004

Related U.S. Application Data

(63) Continuation-in-part of application No. 10/105,899, filed on Mar. 25, 2002, now Pat. No. 6,708,684.

(51) Int. Cl.[7] ..... F41B 5/10
(52) U.S. Cl. ..... 124/25.6; 124/86
(58) Field of Search ..... 124/25.6, 86

(56) References Cited

U.S. PATENT DOCUMENTS 4,207,858 A * 6/1980 Blackstone ..... 124/25.6
4,452,222 A * 6/1984 Quartino et al. ..... 124/23.1
4,596,228 A * 6/1986 Smith ..... 124/25.6
4,834,061 A * 5/1989 Chattin ..... 124/86
5,718,213 A * 2/1998 Gallops et al. ..... 124/25.6
6,425,385 B1 * 7/2002 Gallops, Jr. ..... 124/25.6
6,708,684 B2 * 3/2004 Chattin ..... 124/25.6

* cited by examiner

*Primary Examiner*—John A. Ricci
(74) *Attorney, Agent, or Firm*—Pendorf & Cutliff

(57) ABSTRACT

The present invention concerns a cable guard for use with a compound bow, the compound bow having a handle portion and a pair of opposite bow limbs, a first and a second cable which cross one another in extending between opposite bow limbs and a bowstring, the cable guard includes: a rod having a first end and a second end, wherein the first end of the rod is attached to the handle portion of the compound bow; a housing disposed at the second end of the rod; a pair of swing arms extending opposite to each other and outwardly from the housing in the direction of the bow limbs, the pair of swing arms pivotally connected about a point near one end of the housing; a biasing device in contact with the other end of the housing and the second end of the rod; and wherein when the bowstring is drawn to a draw position, the swing arms move in the direction of the bowstring moving the housing in the direction of the handle compressing the biasing device.

19 Claims, 7 Drawing Sheets

CABLE VIBRAGUARD

This patent application is a continuation-in-part of U.S. patent application Ser. No. 10/105,899, filed Mar. 25, 2002 now U.S. Pat. No. 6,708,684, allowed on Aug. 22, 2003.

FIELD OF THE INVENTION

This invention relates to a cable guard for a compound bow. More specifically, a cable guard that reduces noise generated by the vibration of the cables, and at the same time, helps increase the speed of the arrow.

BACKGROUND OF THE INVENTION

In the sport of archery, the basic configuration and operation of compound bows are generally known as they have been in use for a long time. Compound bows are used a great deal in hunting because they provide several advantages over the simpler non-compound varieties.

Compound archery bows include tension cables and a bowstring that are connected between upper and lower bow limbs. It is customary to dispose the bowstring and the tension cables relatively close together, proximate the vertical centerline of the bow, in order to minimize any twisting torque on the bow limbs.

A notable advantage of compound bows is that a reduction in draw weight is realized, allowing the archer to hold full draw at a draw weight less than that of the required maximum.

Compound bows also achieve more gradual arrow acceleration upon release with reduced stress on the arrow and the archer, resulting in increased arrow speed and shooting accuracy.

A problem presented by compound bows is that noise is generated upon releasing the bowstring to propel the arrow. When the bowstring reaches the end of its arrow-propelling path, the cables (which cross in the center portion of the bow), rub against each other. This rubbing causes frictional forces that may produce cable wear and create noise which may alert game birds and animals.

A popular solution to this problem is to provide compound bows with a cable guard having a rod mount that can provide a selectable degree of displacement of the tension cable from the plane of the path of the bowstring, by rotation of the mount. The rod mount is generally threaded directly into the bow handle area, either above or below the handgrip.

The prior art shows that numerous attempts have been made to maintain the lateral spacing of the cables while reducing the friction between the cables.

U.S. Pat. No. 4,452,222 entitled "Cable Guard for a Compound Bow" to Quartino et al. discloses a cable guard that comprises a rod that extends from the bow handle and beyond the cables when the bow is in a fully drawn position. The rod is positioned laterally from the bowstring to avoid any interference with the bowstring. A cable-retaining member is rotatably and slidably mounted on the rod. The cable-retaining member includes two bores that are perpendicular to the rod for slidably receiving the cables to hold them in a lateral spaced relationship with the bowstring.

U.S. Pat. No. 4,596,228 entitled "Cable Separator for Compound Bows" to Smith discloses a rod attached to the handle portion of the bow that extends rearwardly beyond the bowstring. Positioned about the external surface of the rod is a cable guard assembly which positions a cable on either side of the bow. The purpose of the invention is to prevent an interfering contact of the cable strands with an arrow during impelling flight of the arrow from the bow, thereby obviating impairment of the true flight of the arrow released from the bow.

U.S. Pat. No. 5,718,213, entitled "Swing Arm Cable Guard" to Gallops Jr. et al., discloses a cable guard, including a support member and a swing arm pivotally connected thereto. A cable retaining means having two bores therein for retaining the cables is pivotally mounted on the swing arm. The angle between the support member and the swing arm is such that when the bow is drawn, the distance between the cables, which is contained in the cable retaining means, and the plane of the bowstring travel, is less than the distance between the cables and the plane of bowstring travel when the bow is at rest. Because the cables are closer to the plane of bowstring travel when the bow is drawn, the cables and bow limbs are less stressed when the bow is drawn. The cable guard retaining means may not be adjusted to change the distance between the cable guard retaining means and bowstring.

In the prior art for cable guards of the type described above, the rod on which the retaining members were slidably mounted was required to be of sufficient length to permit the retaining members to be mounted thereon when the bow was in the drawn condition.

Unfortunately, the rod length can be a potential distraction to the archer when the arrow is being shot. Another problem presented by the rod of the prior art is that most archers do not remove the cable guard from their bow for transport, and because many forms of transportation require bows to be cased for transport, the use of such cable guards requires substantial storage area and larger bow cases.

Further, the rod and sliding retainer introduces additional friction into the system, for example, the increased friction force between the cables and the sliding retainer and between the sliding retainer and the support rod as the bowstring is moved from brace position to full draw.

Some of these disadvantages appear to have been overcome by the cable guard disclosed in U.S. Pat. No. 4,834,061 entitled "Cable Vibraguard" to the present inventor, in which a support member has a swing arm pivotally attached thereto. A cable retaining member having two openings therein is located at the free end of the swing arm. The cables pass through and are contained within the openings of the retaining member. When the bow is drawn, the cables travel in a plane parallel to the general direction of the bowstring and cause the retaining member and connected swing arm to be pivoted away from the support member and the bow handle. The present invention is an improvement of the cable guard disclosed in this patent.

The present invention concerns another means for reducing the frictional forces between the cables and the bores of the retaining means.

Another problem presented by a conventional compound bow is that a considerable amount of energy stored in bow limb is wasted by propelling the bow limb forward when the drawn bowstring is released. Instead, it is desirable to use at least a portion of this wasted energy to propel an arrow.

The arrow speed depends upon several factors, one of the most important being the amount of energy put into the bow. Generally speaking, the more total energy put into the bow, the faster that the arrow will be propelled. Increased arrow speed is desirable, especially when hunting and shooting heavy arrows.

Another problem presented by a conventional compound bow is that the crossing cables are located in the point of view of the archer, thus diminishing the visibility of the archer.

Thus, the present inventor feels the necessity of providing a cable guard for a compound bow that is simple, quiet, inexpensive, and less susceptible to wear and tear, increases the visibility for the archer, and, at the same time, increases the arrow speed.

SUMMARY OF THE INVENTION

Therefore, it is an object of this invention to provide a cable guard that separates the cable positioned between the bowstring and the handle portion of a compound bow.

It is yet another object of the present invention to provide a cable guard that decreases the noise generated during use as to not alert or frighten game birds and animals.

It is yet another object of the present invention to provide a cable guard in which the frictional forces generated between the cables and the cable retaining members are reduced when the bow is drawn.

It is yet another object of the present invention to provide a cable guard which does not extend beyond the cables positioned between the bowstring and the handle portion of the compound bow when the bow is in a "relaxed" position.

It is yet another object of the present invention to provide cable guard with reduced hand shock and vibration in order to avoid arm fatigue.

It is yet another object of the present invention to provide a cable guard which is economical to produce and maintain.

It is yet another object of the present invention to provide a cable guard that separates the cable positioned between the bowstring and the handle portion of a compound bow increasing the visibility of the archer.

It is yet another object of the present invention to provide a cable guard that helps increase the speed of the arrow.

In view of the foregoing disadvantages inherent in the known types of cable guard systems in the prior art, the present inventor discovered a unique cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end, wherein the first end of the rod is attached to the handle portion of the compound bow;

a housing disposed at the second end of the rod;

at least one swing arm extending outwardly from the housing, the swing arm connected about a point near one end of the housing via a pivoting means;

a biasing means in the housing; and wherein when the bowstring is drawn to a draw position, the swing arm pivots, thereby compressing the biasing means.

The cable guard further can include: mounting means for attaching the first end of the rod to the handle portion of the compound bow and a cable guide means positioned at the first end of the swing arm, with the cable guide means adapted to slidably receive and separate the first and second cable.

When the bowstring is drawn to a draw position, the cables move in the direction of the bowstring urging the swing arm in the direction of the bowstring. The movement of the swing arm urges a piston in the direction of the handle, thereby compressing the biasing means inside the housing.

When the bowstring is released, the biasing means returns to its relaxed (uncompressed) position and the first and second cables are compelled to stop vibrating by the movement of the biasing means returning to the original position, thereby decreasing the amount of vibration noise produced by the vibrating of the first and the second cable. In addition, a bumper may optionally be attached to the cable guard that may come into contact with the bow strings after the arrow has been shot. The bumper may, at least partially, function to cause the strings to stop vibrating through this contact.

The compression of the biasing means adds an extra tension force, wherein the extra tension force provides the arrow with an increased speed.

In a first preferred embodiment, the biasing means comprises more than one spring.

The above referenced pivoting means (whereby a rotational motion of the swing arm is utilized to compress the biasing means) can be accomplished in numerous ways, including wherein the pivoting means comprises a pin and a cam. In an alternate embodiment, the pivoting means may include a pin such that the end of a swing arm only slidably interacts with the piston to compress the biasing means.

The foregoing has outlined rather broadly the more pertinent and important features of the present invention in order that the detailed description of the invention that follows may be better understood, and the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying other security systems for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several views of the drawings.

DETAILED DESCRIPTION OF THE INVENTION

Figure 1:
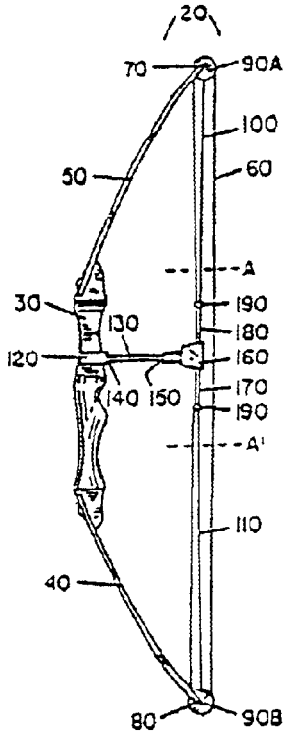
FIG. 1 is a side view illustrating the cable guard of the present invention attached to a compound bow in a rest position.

FIG. 1 is a side view illustrating the cable guard 10 of the present invention attached to a compound bow in a rest position. The cable guard 10 is used with a conventional compound bow 20 having a bow handle 30 and a pair of bow limbs 40, 50. The first bow limb 40 and the second bow limb 50 are oppositely positioned in bow handle 30. Bowstring 60 spans between a first bow tip 70 and a second bow tip 80. The bowstring 60 then continues and extends over the pulleys 90A, 90B positioned at or proximate to each of the bow tips 70, 80, and then the two ends of the bowstring 60, designated first cable end 100 and second cable end 110, cross to the opposite limb at which point they are attached to define a compound bow 20.

Figure 2:
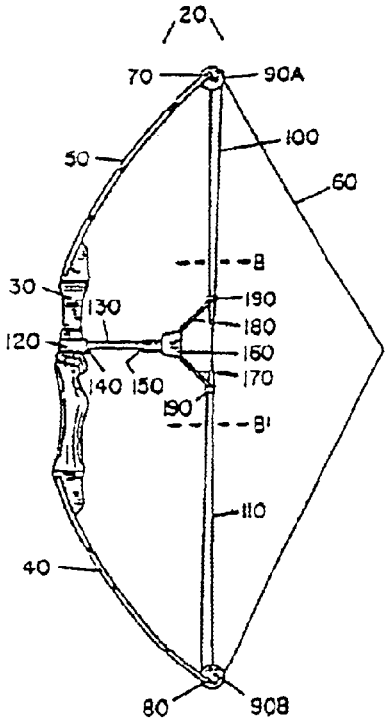
FIG. 2 is a side view illustrating the cable guard of the present invention attached to a compound bow in a drawn position.

FIG. 2 is a side view illustrating the cable guard of the present invention attached to a compound bow in a drawn position.

Figure 3:
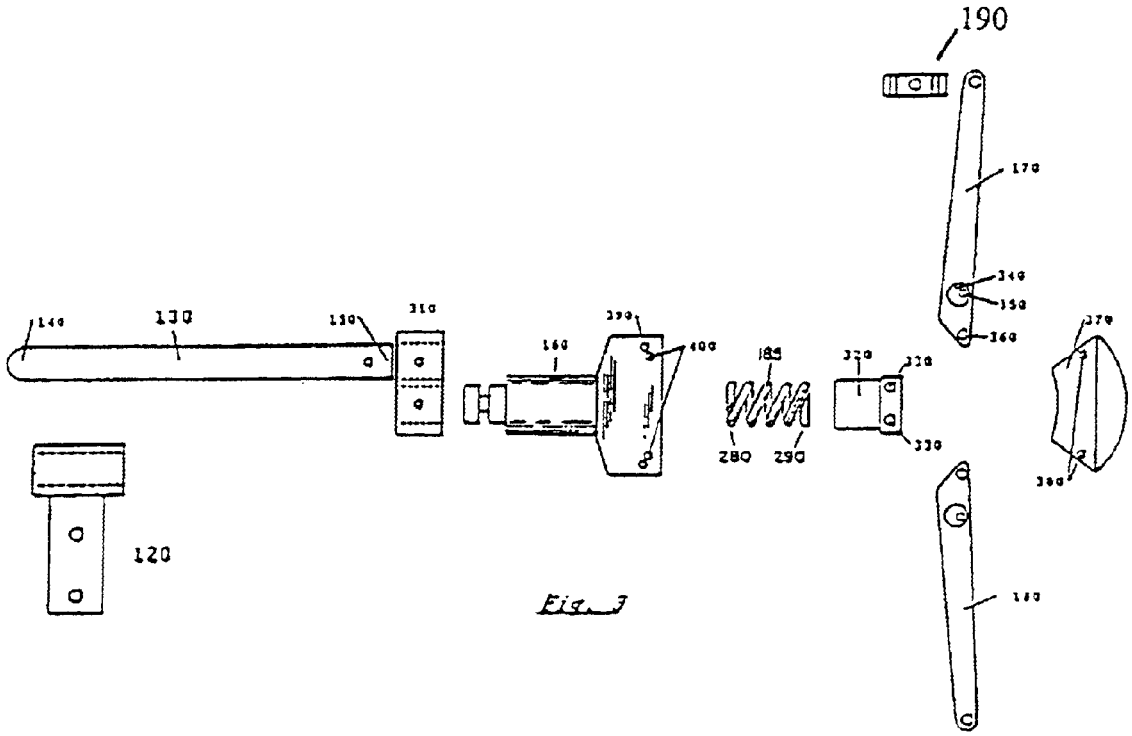
FIG. 3 is a partial exploded section taken along line A-A$^1$ on FIG. 1 of an embodiment of the present invention.

FIG. 3 is a partial section taken along line A-A[1] on FIG. 1 and provides greater detail of an embodiment of the cable guard 10 of the present invention.

Figure 4:
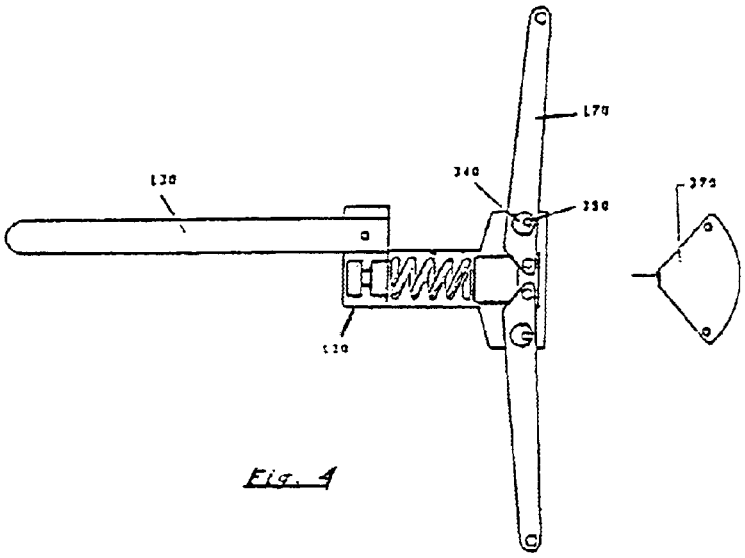
FIG. 4 is a partial section view of FIG. 3.

FIG. 4 is a partial section view of FIG. 3.

Figure 5A:
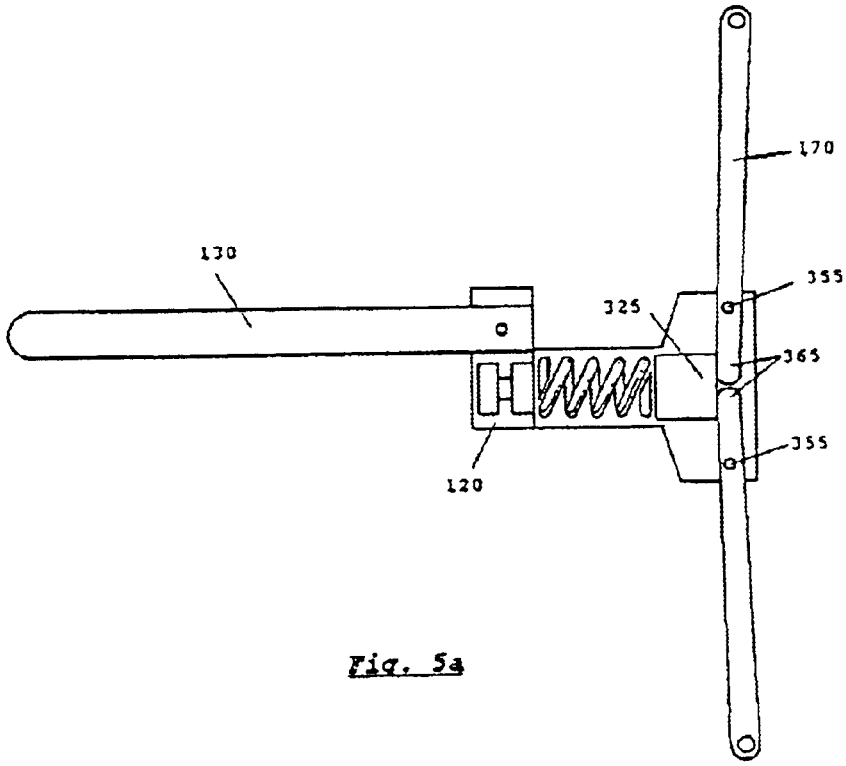
FIG. 5*a* is a partial section of an embodiment of the present invention.
Figure 5B:
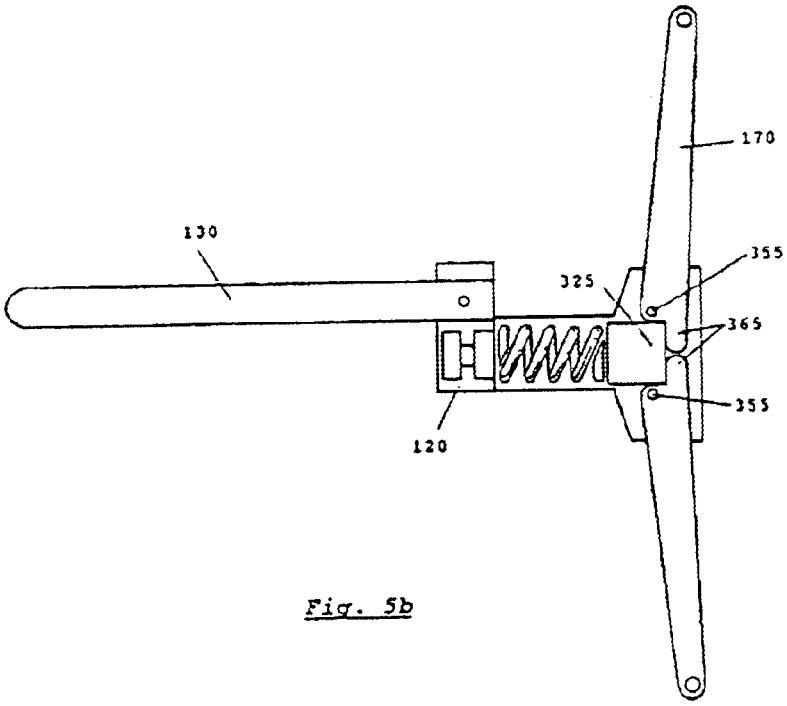
FIG. 5*b* is a partial section of an embodiment of the present invention.

FIG. 5*a* is a partial section view of an alternate embodiment of the present invention. This embodiment utilizes a pin 355 to allow the swing arm 170, 180 to pivot. In this embodiment, the swing arm is slidably connected to piston 325. When the swing arm 170 is pivoted to a draw position, swing arm 170 pivots about pin 355 thereby causing the biasing means 185 to be compressed (via the piston in this embodiment). Note that the swing arms 170, 180 illustrated in FIG. 5*a* may be of varying geometry as illustrated for example in FIG. 5*b* such that the location of pin 355 can be chosen such that the contact area between the swing arm 170, 180 and the piston 325 can be controlled during the pivoting of the swing arms through the draw of the bow.

Figure 6:
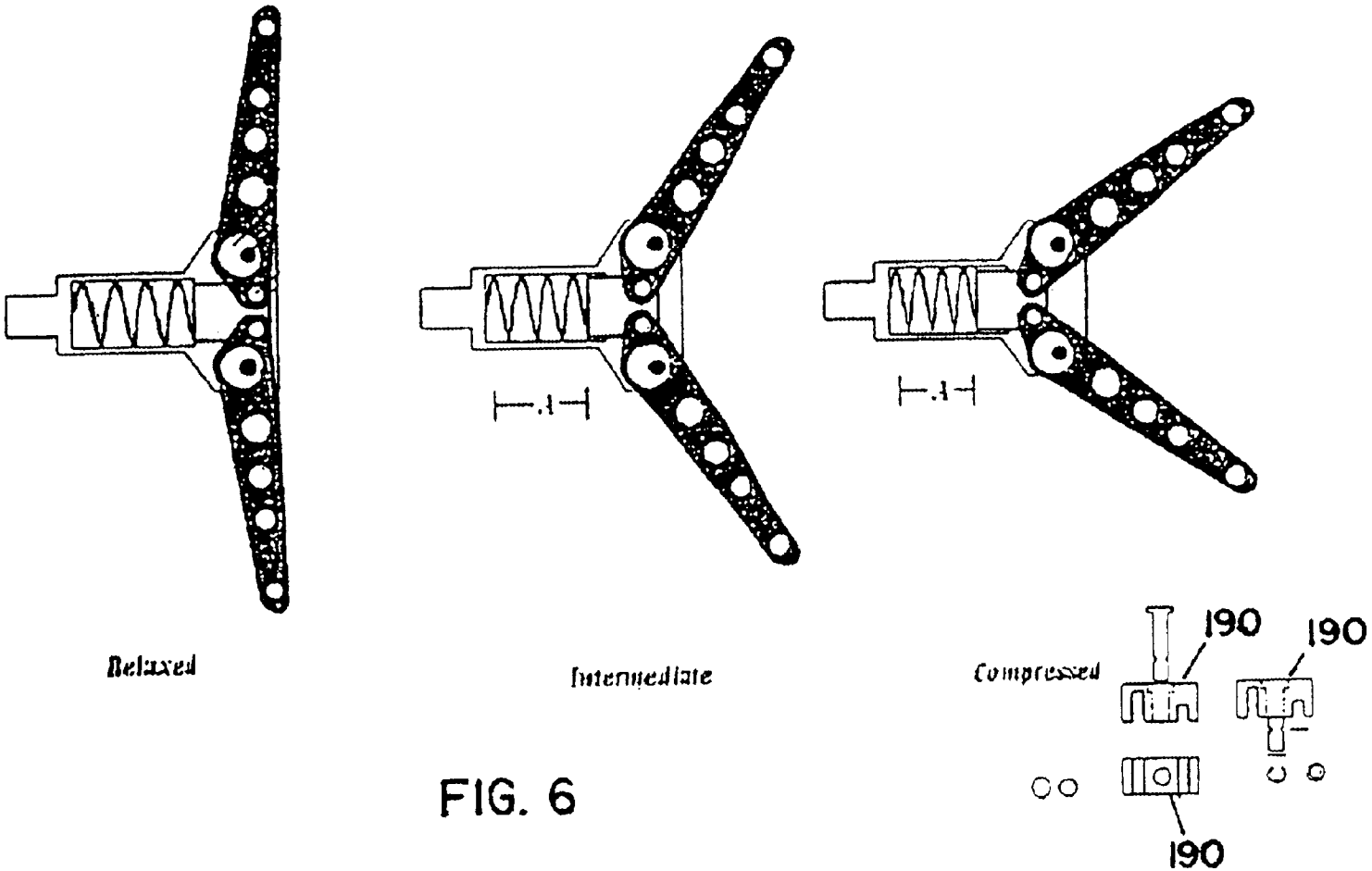
FIG. 6 is a partial section view illustrating a preferred embodiment of the present invention in a relaxed, intermediate and compressed state.
Figure 7A:
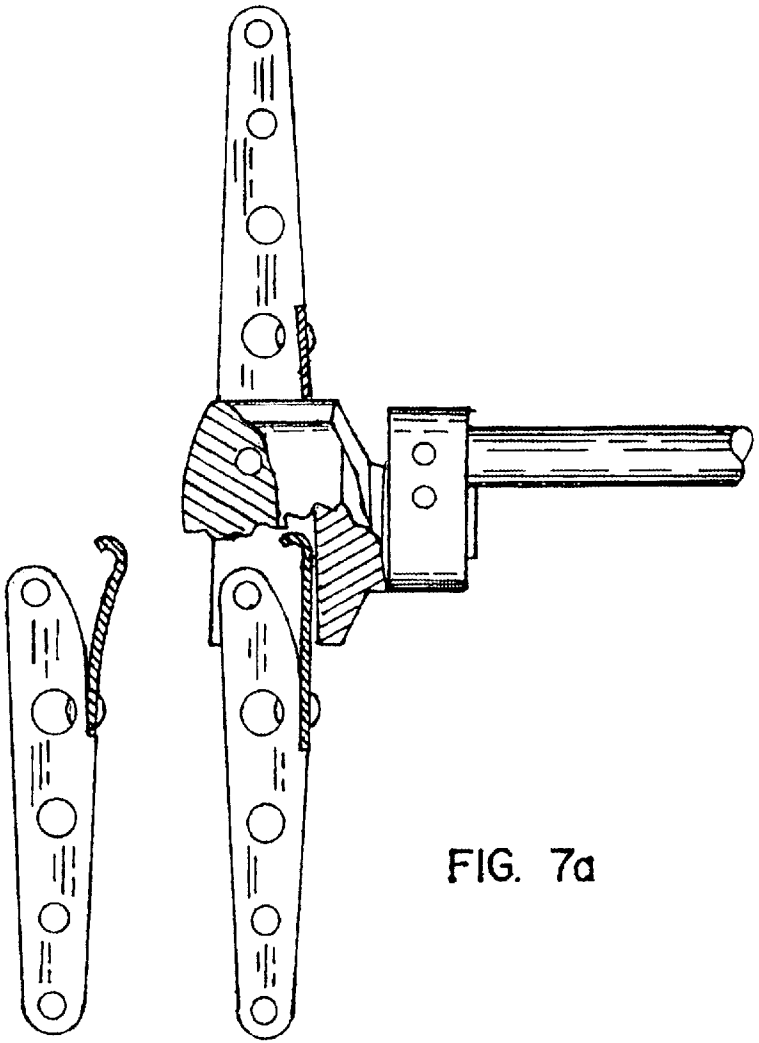
FIG. 7*a* is an enlarged side view of a single swing arm showing a leaf spring as biasing means.
Figure 7B:
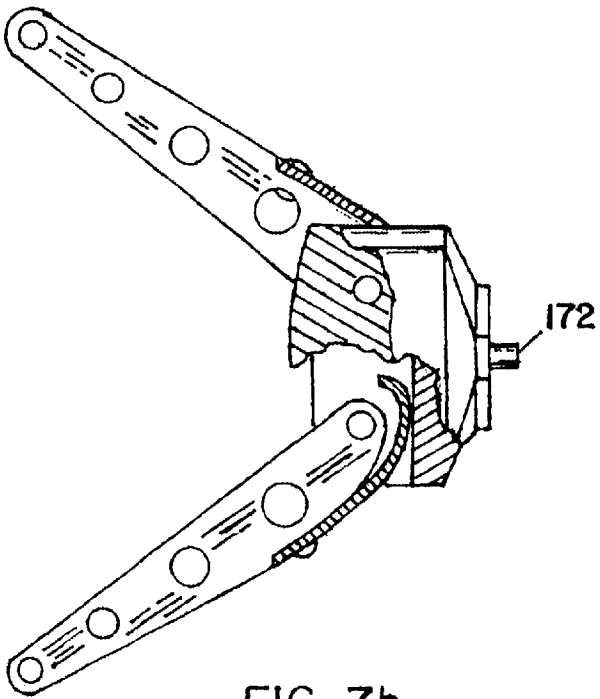
FIG. 7*b* is an enlarged side view of a single swing arm showing leaf spring as biasing means in the compressed state.
Figure 8:
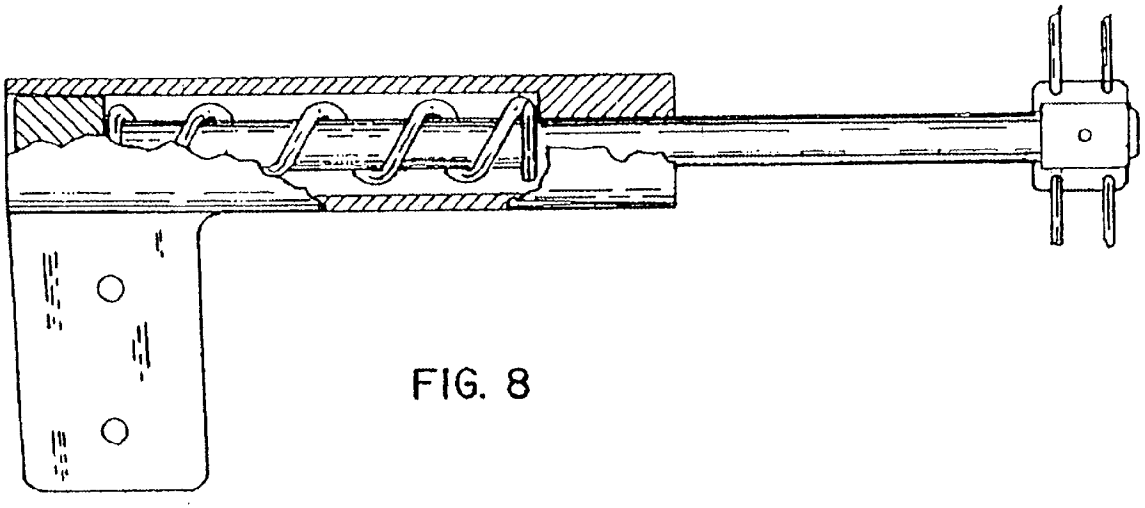
FIG. 8 is an enlarged side view of a single swing arm showing a coil spring as biasing means.
Figure 9:
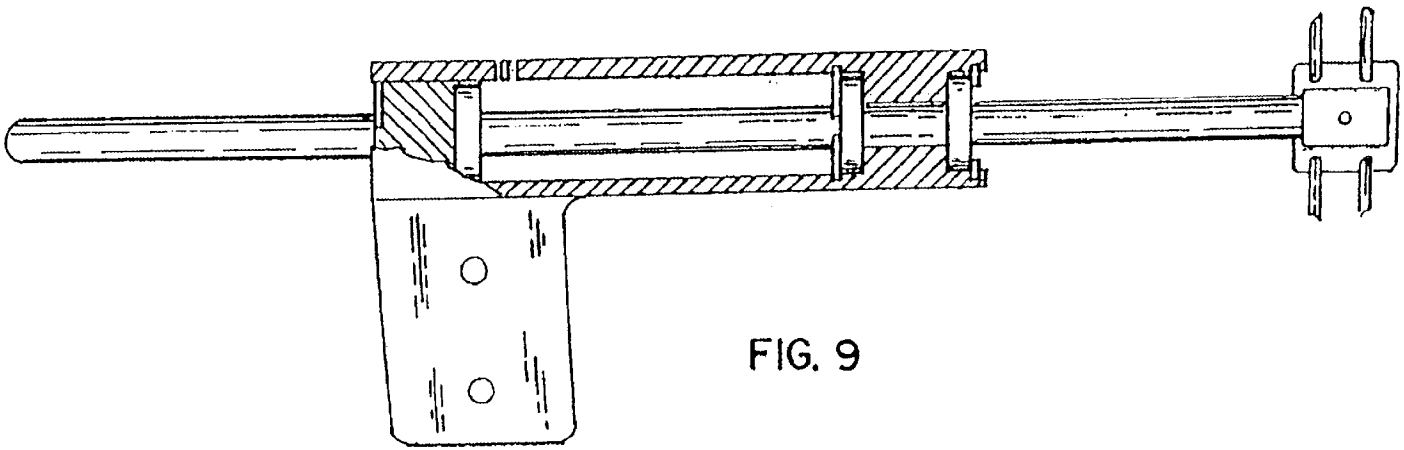
FIG. 9 is an enlarged side view of a single swing arm showing a air spring as biasing means.
Figure 10:
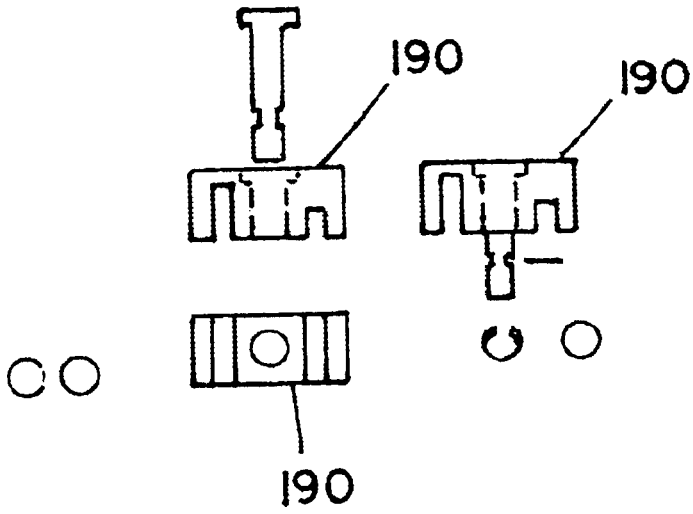
FIG. 10 is an enlarged side view of the cable guide means of the present invention.

FIG. 6 is a partial section view illustrating a preferred embodiment of the present invention in a relaxed, intermediate and compressed state.

Rod

In its basic embodiment, the rod 130 includes a first end 140 and a second end 150.

The mounting means 120 firmly attaches the first end 140 of the rod 130 to the handle portion 30 of the compound bow 20.

An attaching means 310 attaches the second end 150 to a housing 160 (although a further embodiment would allow for other attaching means, such as the rod second end 150 having a threaded section such that it could be attached directly to the housing 160).

Housing

The housing 160 is disposed at the second end 150 of the rod 130, the housing 160 having a first end, and a second end.

At least one swing arm 170, 180 is pivotably attached to the housing 160 via a pivoting means (such as cam 340 and a cam pin 350 in FIGS. 3–4, or via pin 355 as illustrated in FIG. 5). Cam pin 350 is received in housing bore 390. Each arm includes a first end 200 and a second end 205. In an alternate preferred embodiment, the cable guard may have only one swing arm 170 or 180.

The swing arm may also be pivotably attached to a piston 320 as shown in the embodiment of FIGS. 3–4. The swing arm may be attached to the piston 320 by a fastening means such as floating pins 360 which may be received in piston bores 330 in the piston 320.

The swing arm may also be slidably connected to the piston 320 as shown in FIG. 5.

A cable guide means 190 may be positioned at the first end 200 of each swing arm 170, 180. Each cable retaining means 190 may include openings 210 and 220 therein to retain cables 100 and 110. The opening 210 may preferably have a depth greater than the depth of the opening 220 in order to prevent the cables from touching or rubbing each other.

The cable guide means 190 slidably receive and separate the first cable 100 and second cable 110. Thus, the first and second cable are slidably received and separated during the drawing and release of the bowstring 20, thereby ensuring that the first cable 100 and second cable 110 do not rub against each other and decreasing the amount of noise produced by the vibrations of the first 100 and second 110 cables immediately after the bowstring 20 has propelled an arrow.

A bumper 370 may be placed over the housing 160, wherein a respective pin 380 is received by a respective housing bore 400, or some other suitable method of attachment.

Biasing Means

The biasing means 185, such as a spring, is disposed inside the housing 160. The biasing means 185 includes a first end 280 and a second end 290.

The biasing means 185 is preferably a coil spring having a pre-set force. The coil spring is preferably made of steel, but can be made of any other suitable material.

The present invention contemplates also the use of any type of spring capable of storing power when compressed, such as an air spring, leaf spring, or other energy storage device as biasing means.

The biasing means 185 has an outer diameter slightly smaller than the inner diameter of the housing 160.

The present invention also contemplates the use of a biasing means 185 comprising more than one spring.

The length of the biasing means depends on the type of compound bow used and is controlled to provide a "stopped" action of the swing arm; thus, it will not interfere with the discharged bowstring and arrow. Thus, when the biasing means goes back to its normal relaxed position, the biasing means provides the bow with an immediate stopping action that prevents any further movement of the swing arm or the cables.

Optionally, the present invention contemplates the use of an adjusting rod 172 to engage the biasing means and change the pre-set compression force of the biasing means.

As can be seen from FIG. 1, rest position, the swing arms are substantially located in the same plane. In the drawn position, FIG. 3, the swing arms are diverging rearwardly to a substantially closed position. It will be seen that when bowstring 60 is drawn, cables 100 and 110 move in the direction of the bowstring and both cables retaining means 190 and swing arms 170, 180 are pivoted to the position shown in FIG. 2.

When the bowstring is drawn to a draw position, the cables move in the direction of the bowstring urging the swing arms in the direction of the bowstring. The movement of the swing arms urges the piston in the direction of the handle compressing the biasing means inside the housing.

The compression of the biasing means adds extra tension force to the biasing means. Thus, upon releasing the bowstring, the arrow is propelled by the pre-loaded tension of the biasing means, the extra tension on the biasing means, and, of course, also by the tension put into the bow by the final draw of the bowstring. The biasing means causes the energy that propels the arrow to be greater than the energy, which is required on the final draw of the bow. This increases the speed of the arrow.

FIG. 6 illustrates three states of the cable guard; relaxed, intermediate and compressed.

Thus, the cable guard of the present invention helps to overcome the problem presented by a conventional compound bow regarding the waste of energy produced by propelling the bow limb forward when drawn bowstring is released. Thus, the additional energy allows the user to use a lighter compound bow without sacrificing arrow speed.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end, wherein the first end of the rod is attached to the handle portion of the compound bow;

a housing disposed at the second end of the rod;

at least one swing arm extending outwardly from the housing, the swing arm connected about a point near one end of the housing via a pivoting means;

a biasing means in the housing; and wherein when the bowstring is drawn to a draw position, the swing arm pivots, thereby compressing said biasing means.

2. The cable guard of claim 1, wherein the pivoting means is a pin.

3. The cable guard of claim 2, wherein when the bowstring is released, the biasing means moves back to it's original position and the first and second cables are compelled to stop vibrating by the movement of the biasing means returning to the original position thereby decreasing the amount of vibration noise produced by the vibrating of the first and the second cable.

4. The cable guard of claim 2, wherein the biasing means is elected from the group consisting of coil spring, air spring, and leaf spring.

5. The cable guard of claim 2, wherein the biasing means comprises at least one spring.

6. The cable guard of claim 2, further comprising an adjusting rod adapted to engage the biasing means and change a pre-set compression force of the biasing means.

7. The cable guard of claim 2, wherein the compression of the biasing means adds an extra tension force to the biasing means, and wherein the extra tension force provides the arrow with an increased speed.

8. The cable guard of claim 2, wherein the guide means includes a first and a second opening formed therethrough.

9. The cable guard of claim 8, wherein the depth of the first opening is greater than the depth of the second opening to avoid that the cables touch each other.

10. The cable guard of claim 2, wherein the rod comprises a first section and a second section, wherein the first section has a diameter greater than a diameter of the second section, wherein the first section includes an internal threaded end and the second section includes an external threaded end, wherein the external threaded end of the second section is threaded to the internal threaded end of the first section.

11. A cable guard for use with a compound bow, the compound bow having a handle portion and a pair of opposite bow limbs, a first and a second cable which cross one another in extending between opposite bow limbs and a bowstring, the cable guard comprising:

a rod having a first end and a second end;

a mounting means for attaching the first end of the rod to the handle portion of the compound bow;

a housing disposed at the second end of the rod, wherein the second end of the rod is attached to the housing;

at least one swing arm, wherein the swing arm has a first end and a second end, wherein the second end of the swing arm is pivotally connected about a point near the first end of the housing via a cam and a cam pin;

a biasing means disposed inside the housing; and a cable guide means positioned at the first end of each swing arm, the cable guide means adapted for slidably receiving and separating the first and second cable;

wherein when the bowstring is drawn to a draw position, the cables move in the direction of the bowstring urging the swing arm in the direction of the bowstring;

wherein the movement of the swing arm urges to compress the biasing means.

12. The cable guard of claim 11, wherein when the bowstring is released, the biasing means moves back to it's original position and the first and second cables are compelled to stop vibrating by the movement of the biasing means returning to the original position thereby decreasing the amount of vibration noise produced by the vibrating of the first and the second cable.

13. The cable guard of claim 11, wherein the biasing means is elected from the group consisting of coil spring, air spring, and leaf spring.

14. The cable guard of claim 11, wherein the biasing means comprises at least one spring.

15. The cable guard of claim 11, further comprising an adjusting rod adapted to engage the biasing means and change a pre-set compression force of the biasing means.

16. The cable guard of claim 11, wherein the compression of the biasing means adds an extra tension force to the biasing means, and wherein the extra tension force provides the arrow with an increased speed.

17. The cable guard of claim 11, wherein the guide means includes a first and a second opening formed therethrough.

18. The cable guard of claim 17, wherein the depth of the first opening is greater than the depth of the second opening to avoid that the cables touch each other.

19. The cable guard of claim 11, further comprising a bumper located over the housing, wherein the bumper includes a pin that engages with a housing bore.

* * * * *